US007308724B2

(12) United States Patent
Ho

(10) Patent No.: US 7,308,724 B2
(45) Date of Patent: Dec. 18, 2007

(54) HOUSEHOLD BATHING WATER MASSAGE DEVICE

(76) Inventor: Chun-Ta Ho, No. 116, Lane 33, Wunhua Rd., Sijhou Township, Changhua County 524 (TW)

( * ) Notice: Subject to any disclaimer, the term of this patent is extended or adjusted under 35 U.S.C. 154(b) by 430 days.

(21) Appl. No.: 11/092,693

(22) Filed: Mar. 30, 2005

(65) Prior Publication Data

US 2006/0218721 A1 Oct. 5, 2006

(51) Int. Cl.
*A47K 3/20* (2006.01)

(52) U.S. Cl. ..... 4/567; 4/597; 4/603; 4/615

(58) Field of Classification Search ..... 4/567, 4/568, 570, 597, 603, 615
See application file for complete search history.

(56) References Cited

U.S. PATENT DOCUMENTS 1,590,121 A * 6/1926 Pitcher ..... 4/615 X
3,717,142 A * 2/1973 Mickelson ..... 4/570 X
4,696,428 A * 9/1987 Shakalis ..... 4/615 X
5,144,702 A * 9/1992 Haraga et al. ..... 4/541.2 X
5,293,654 A * 3/1994 Castwall et al. ..... 4/597 X

* cited by examiner

*Primary Examiner*—Robert M. Fetsuga
(74) *Attorney, Agent, or Firm*—Rabin & Berdo, P.C.

(57) ABSTRACT

A household bathing water massage device comprised of a shower head connected below an existent cold and hot water faucet with a water volume controller installed in between, a three-way connector installed at the lower end, and a hose respectively connected to the controller and filter. The controller has an internally disposed pressurizing motor, frequency transformer, microcontroller board, and remote control unit, with the remote control unit equipped with a plurality of push-type keys. Furthermore, the end of the hose provides for the installation of water discharge nozzles. As such, user operation varies the intensity of the water output force as well as changes in water volume duration, utilizing the shower head accessories and differently shaped nozzles to produce streams of differing force directed against the body for water massage applications, thereby revitalizing cells, eliminating fatigue, and promoting metabolism to comfortably relax the body and spirit.

5 Claims, 10 Drawing Sheets

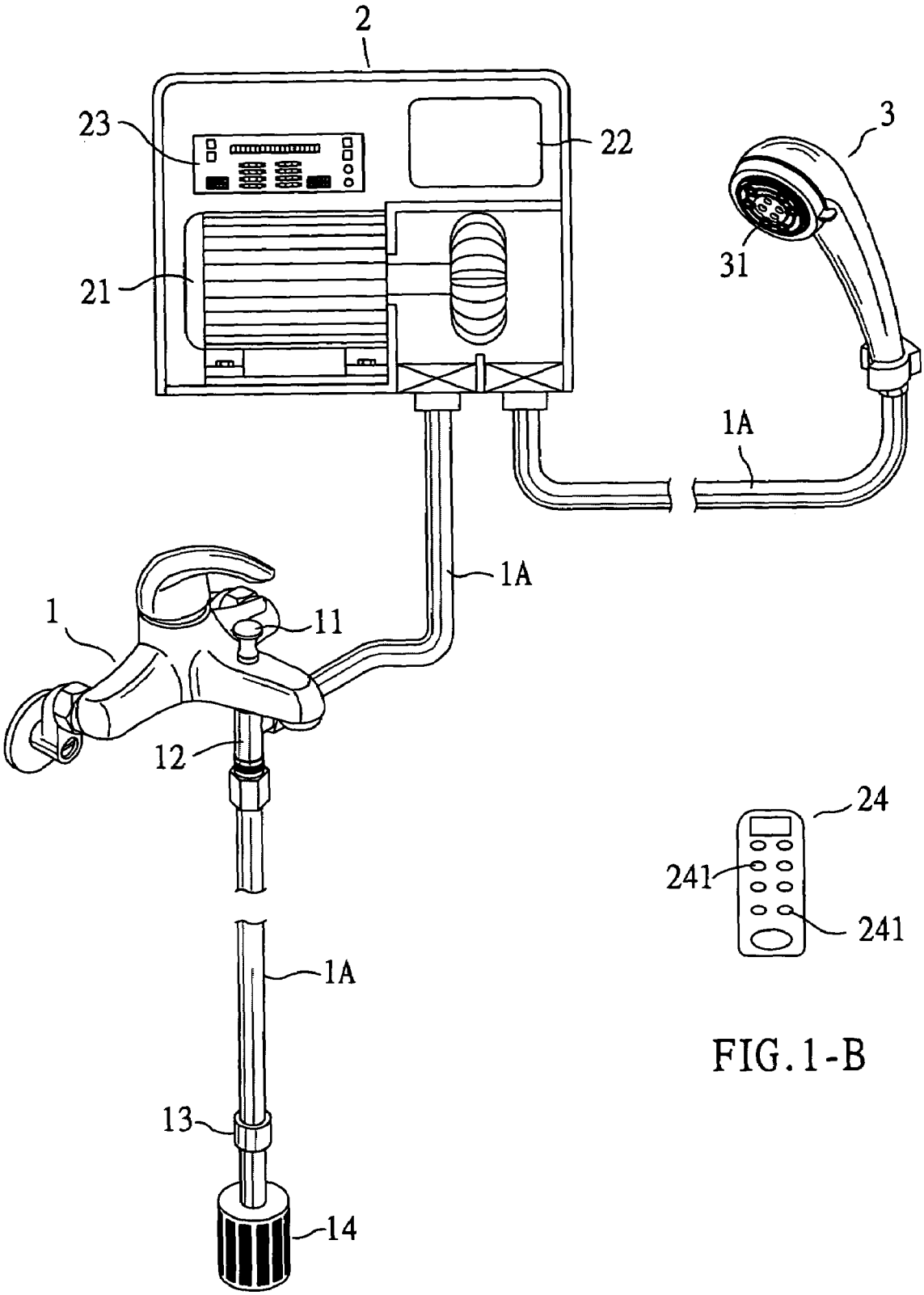
FIG.1-A
FIG.1-B

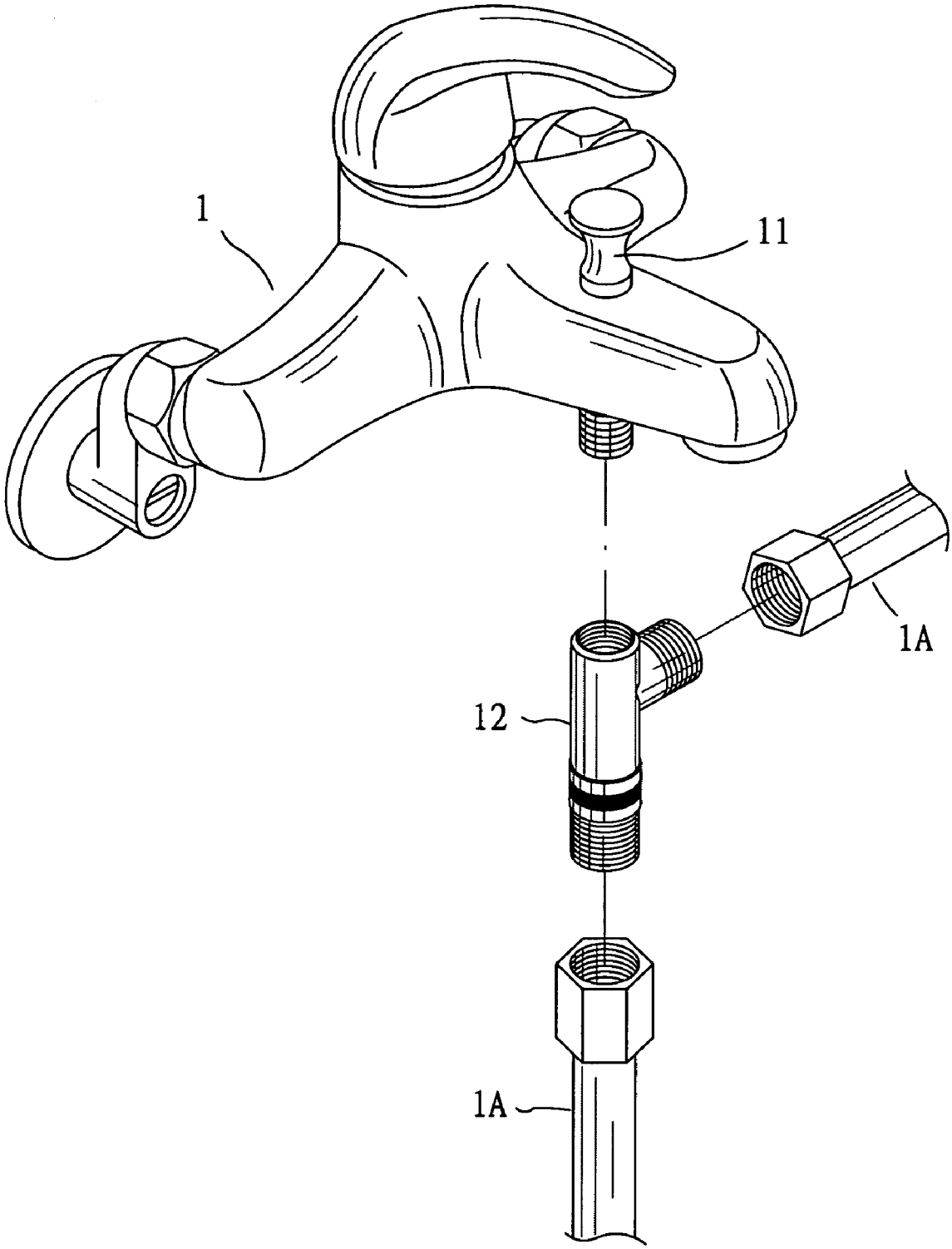
FIG. 1-C

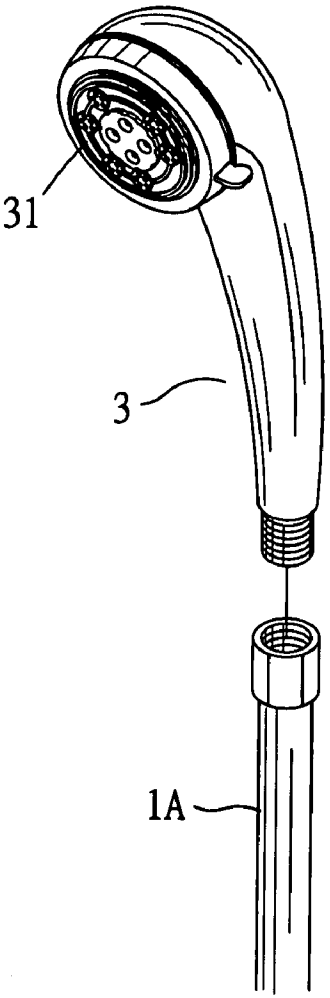
FIG. 2-A
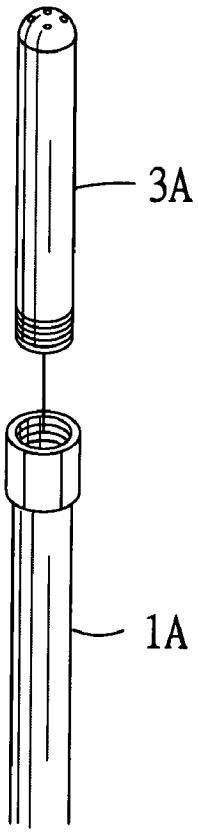
FIG. 2-B
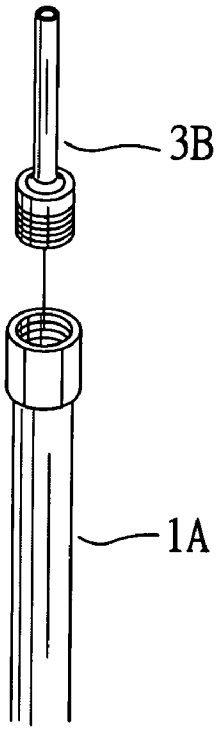
FIG. 2-C

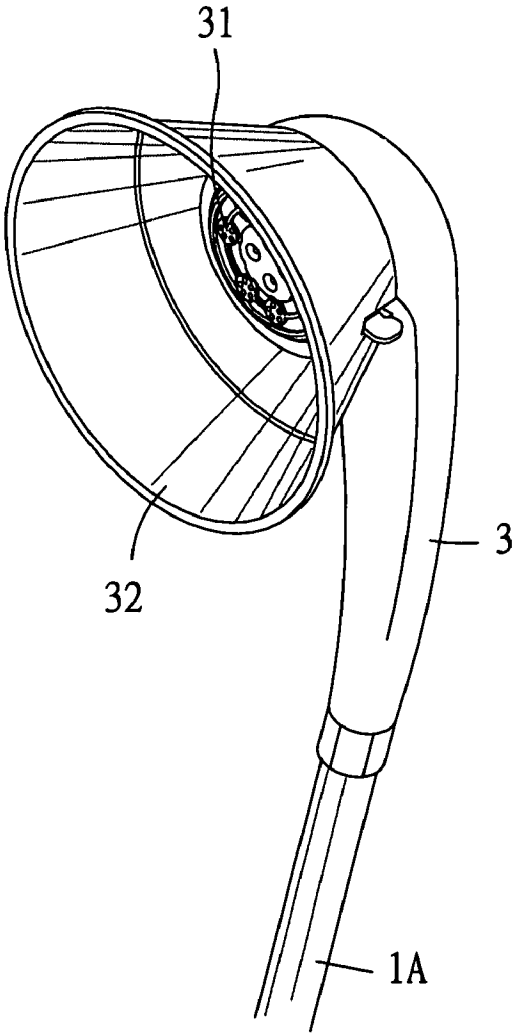
FIG. 5-B
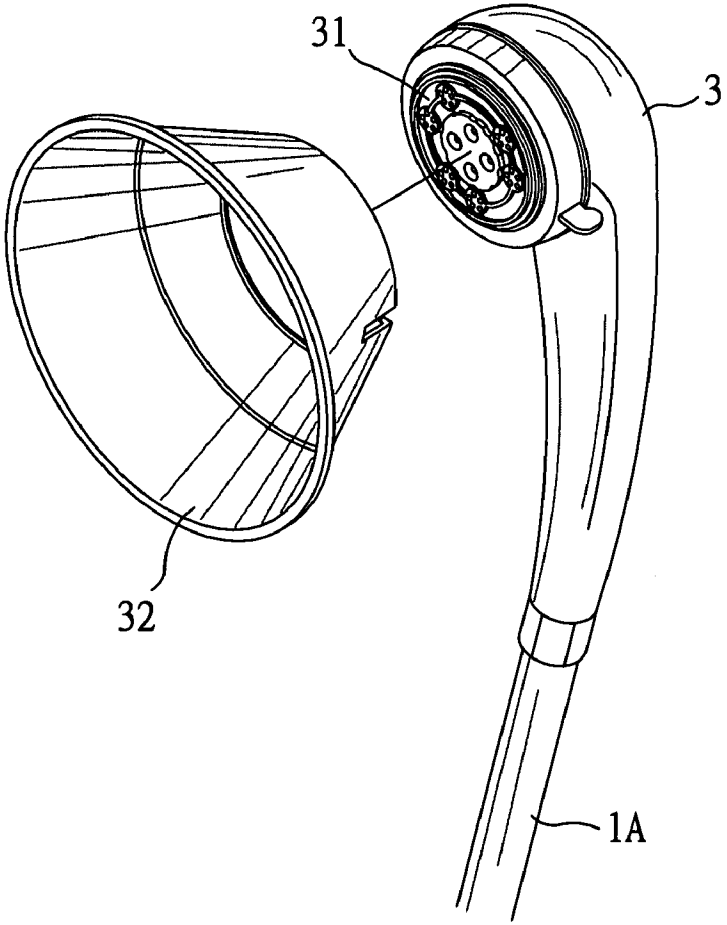
FIG. 5-A

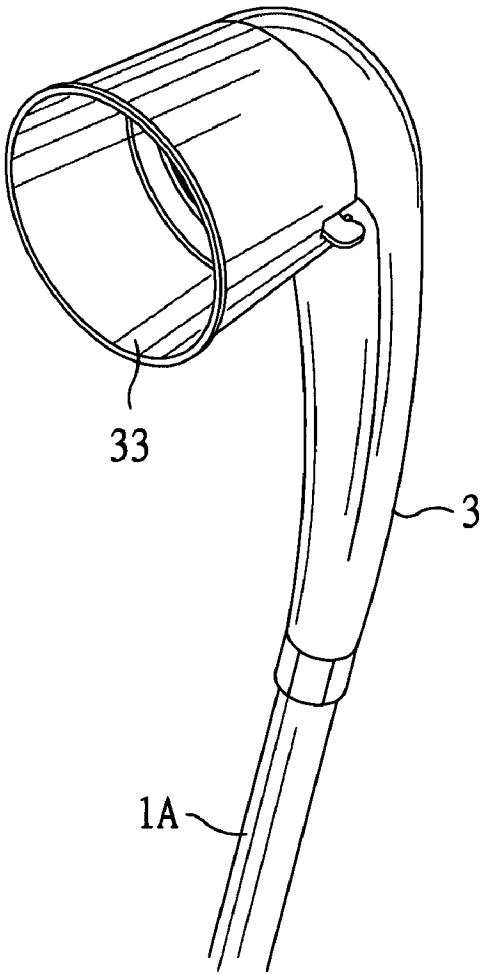
FIG.6-B
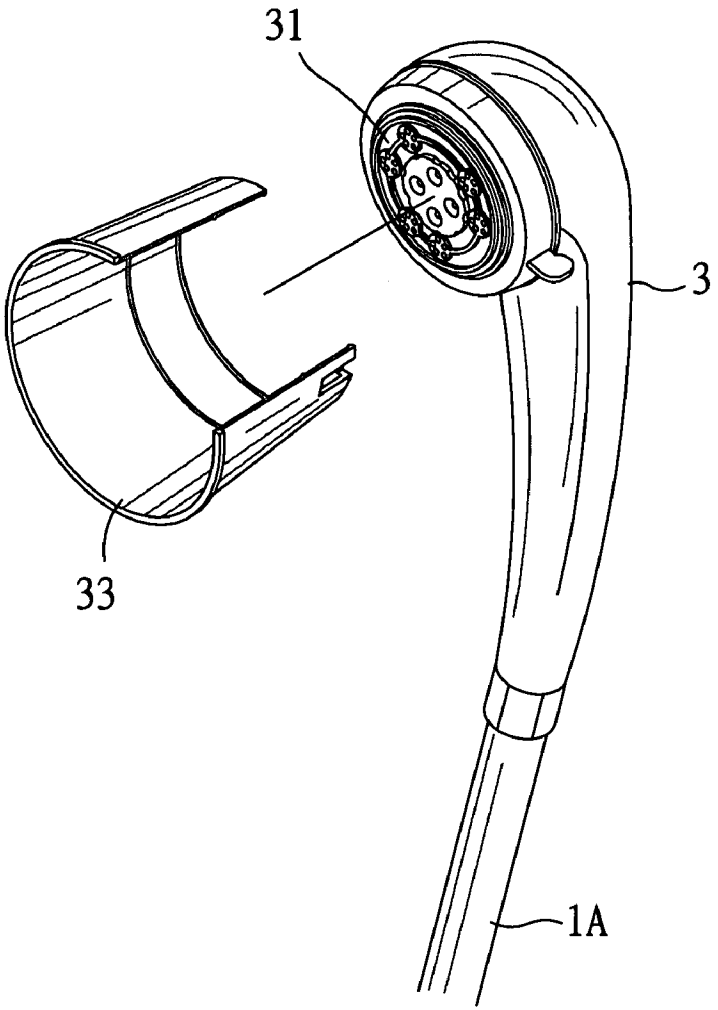
FIG.6-A

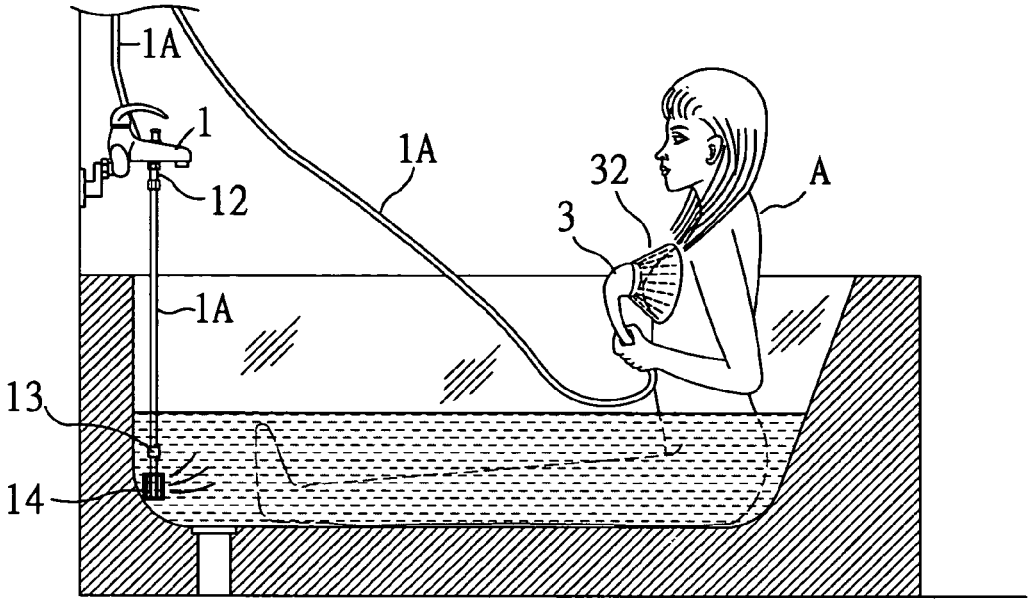
FIG.5-C
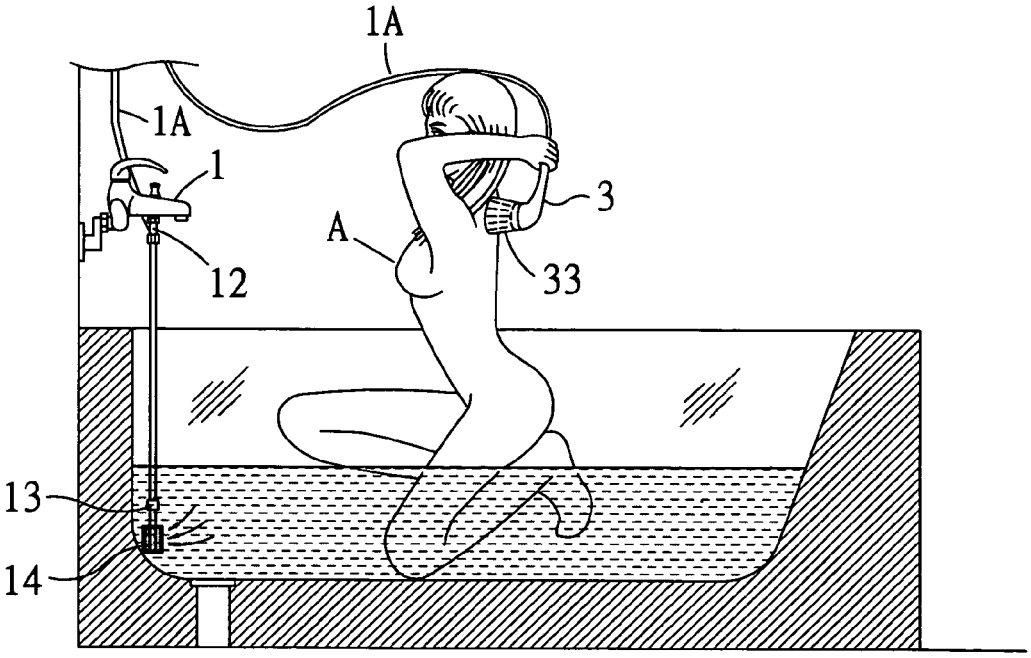
FIG.6-C

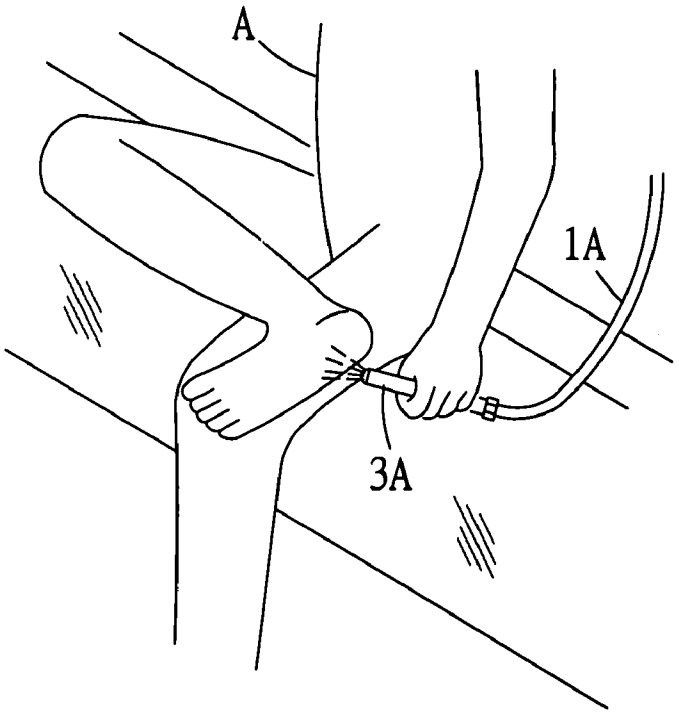
FIG. 7-B
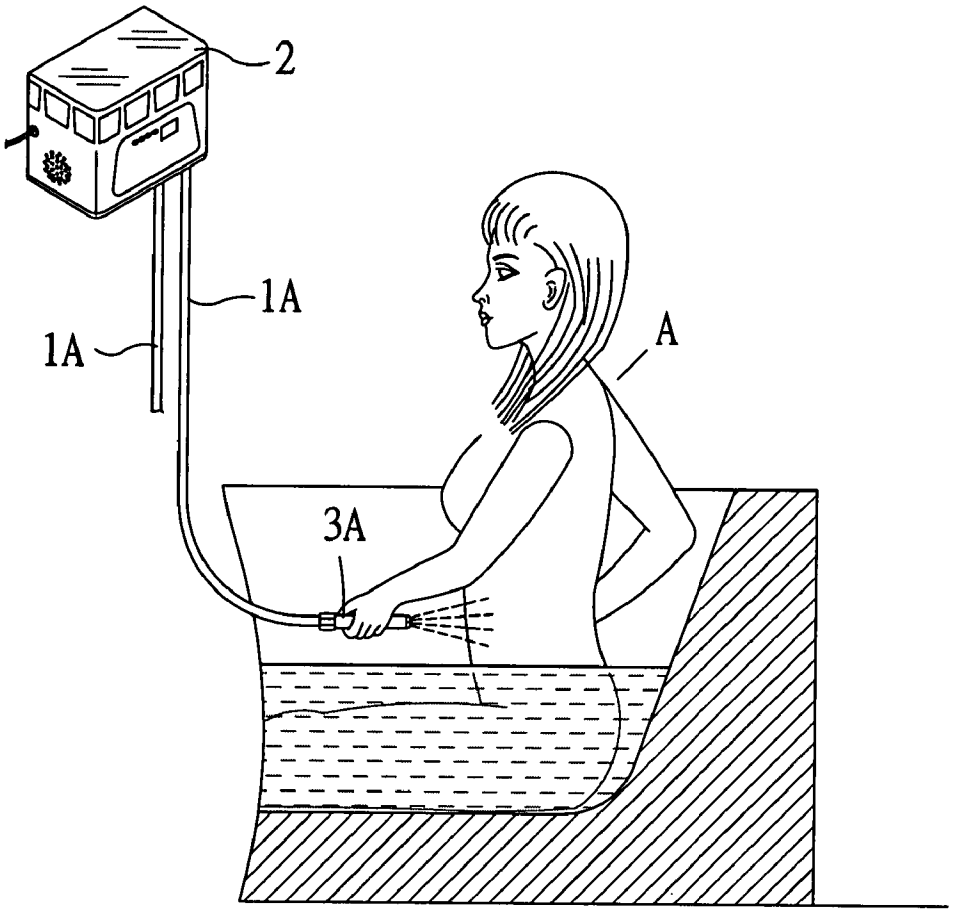
FIG. 7-A

HOUSEHOLD BATHING WATER MASSAGE DEVICE

BACKGROUND OF THE INVENTION

1) Field of the Invention

The invention herein relates to a household bathing water massage device that provides the user streams of differing force directed against the body for water massage applications, thereby revitalizing cells, eliminating fatigue, and promoting metabolism to comfortably relax the body and spirit.

2) Description of the Prior Art

When people want to soak in a bath for physical relaxation, they often go to a spa hydrotherapy center that provides professional services, the bathing pool facilities at the site fulfilling their objectives. However, when many people use the massage pool, showers, and so on, one must patiently stand in line and with the wait consuming time and allowing little actual time for use, there is not much effectiveness to speak of and, furthermore, the extent of sanitation causes concern about contagious diseases; the expense for treating the minor infections and the lifelong suffering from the serious ailments. Although the industry stresses absolute attention to public health, the hazards still exist. Additionally, consumers generally cannot afford spa services on a daily basis and thus go once every few days, but fatigue occurs each day. As a result, some people purchase a specialized bathtub for use at home, thereby avoiding standing in line and, furthermore, bathe whenever and for as long as desired without interference, and in complete privacy. However, such an approach often lacks the so-called whirlpool effect, though the capacity allows for bathtub soaking.

SUMMARY OF THE INVENTION

In view of the said situation, the applicant of the invention herein, based on many years experience gained while engaged in the relevant fields of manufacturing, developed the content of the present invention.

The primary objective of the invention herein is to provide a household bathing water massage device comprised of a shower head connected below an existent cold and hot water faucet in a bathroom with a water volume controller installed in between, a three-way connector installed at the lower end of the cold and hot water faucet pull button, a hose respectively connected to the controller and filter via a check valve and, furthermore, the controller has an internally disposed pressurizing motor, frequency transformer, microcontroller board, and remote control unit, with the said remote control unit equipped with a plurality of push-type keys; furthermore, the end of the hose between the controller and the shower head provides for the installation of water discharge nozzles. As such, the user operatively varies the intensity of the water output force as well as changes in water volume duration, utilizing the shower head accessories and differently shaped nozzles to produce streams of differing force directed against the body for water massage applications, thereby revitalizing cells, eliminating fatigue, and promoting metabolism to comfortably relax the body and spirit.

Another objective of the invention herein is to provide a household bathing water massage device in which the three-way connector as well as the controller, check valve and filter installed at the lower end of the cold and hot water faucet pull button is placed in a bath pail or a bathtub filled with a volume of water such that the volume of water utilized is continuously recirculated by the operation of the controller to effectively conserve water resources.

BRIEF DESCRIPTION OF THE DRAWINGS

FIG. 1-A is a isometric drawing of the structure of the invention herein (1).

FIG. 1-B is an isometric drawing of the remote control unit of the invention herein.

FIG. 1-C is a isometric drawing of the structure of the invention herein (2).

FIG. 2-A is an isometric drawing of the accessory of the invention herein (1).

FIG. 2-B is an isometric drawing of the accessory of the invention herein (2).

FIG. 2-C is an isometric drawing of the accessory of the invention herein (3).

FIG. 5-A is an isometric drawing of the shower head of the invention herein with the flared annular hood installed (1).

FIG. 5-B is an isometric drawing of the shower head of the invention herein with the flared annular hood installed (2).

FIG. 5-C is an isometric drawing of an embodiment of the invention herein (3).

FIG. 6-A is an isometric drawing of the shower head of the invention herein with the tubular annular hood installed (1).

FIG. 6-B is an isometric drawing of the shower head of the invention herein with the tubular annular hood installed (2).

FIG. 6-C is an isometric drawing of an embodiment of the invention herein (4).

FIG. 7-A is an orthographic drawing of an embodiment of the invention herein (5).

FIG. 7-B is an isometric drawing of an embodiment of the invention herein (6).

DETAILED DESCRIPTION OF THE PREFERRED EMBODIMENTS

Figure 3:
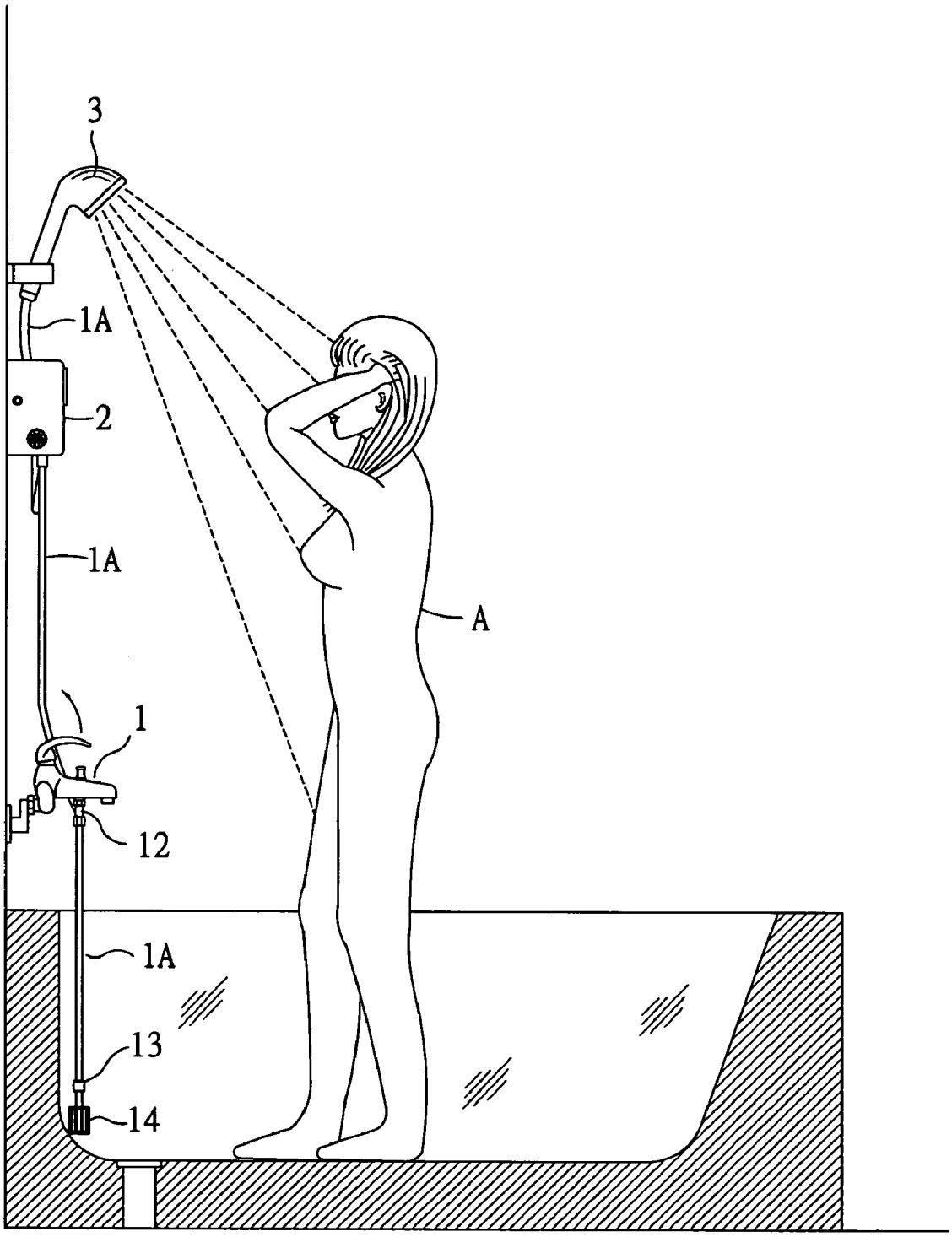
FIG. 3 is an orthographic drawing of an embodiment of the invention herein (1).

Referring to FIG. 1-A, FIG. 1-B, and FIG. 1-C, the household bathing water massage device of the invention herein is comprised of a shower head 3 connected below an existent cold and hot water faucet 1 in a bathroom with a water volume controller 2 installed in between, a three-way connector 12 (as shown in FIG. 1-C) installed at the lower end of the cold and hot water faucet 1 pull button 11, a hose 1A respectively connected to the controller 2 and filter 14 via a check valve 13 and, furthermore, the controller 2 has an internally disposed pressurizing motor 21, frequency transformer 22, microcontroller board 23, and remote control unit 24, with the said remote control unit 24 equipped with a plurality of push-type keys 241 (as shown in FIG. 1-B), the said keys 241 providing for user selected water volume quantity, water stream strength, water output duration, and other functions such that after user A presses and enters, the set data is wirelessly forwarded to the microcontroller board 23 to prompt operation; furthermore, in addition to the shower head 3 at the end of the hose 1A (as shown in FIG.

2-A) connected to the controller 2 and consisting of a water discharge rotary plate 31 having a range of large and small diameter perforations, the hose A1 also provides for the installation of a water discharge multi-stream nozzle 3A (as shown in FIG. 2-B) and a single-stream nozzle 3B (as shown in FIG. 2-C).

Figure 4:
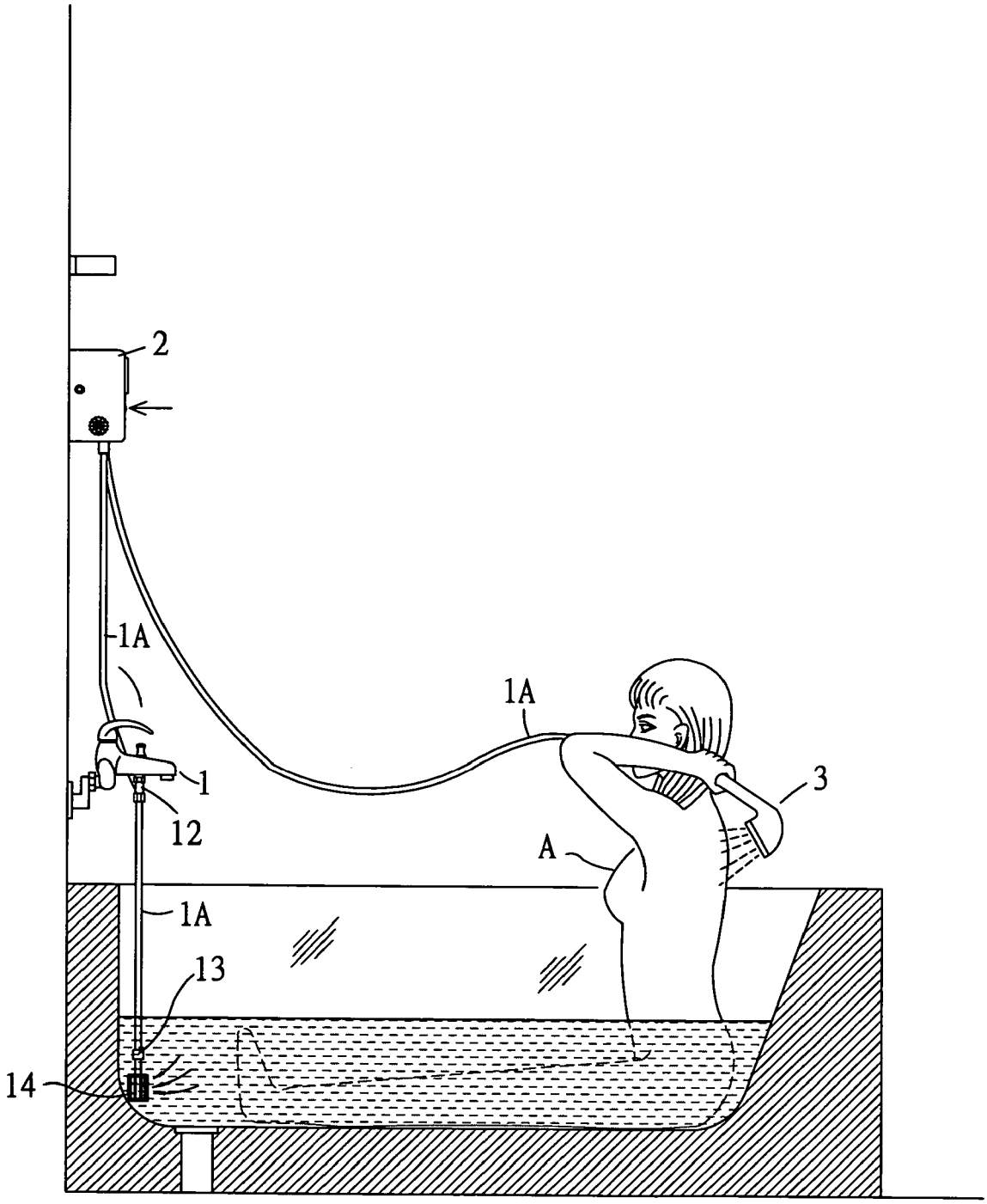
FIG. 4 is an orthographic drawing of an embodiment of the invention herein (2).

As such, prior to a water massage, operating the pull button 11 enables water output from the shower head 3 via the three-way connector 12 at the cold and hot water faucet 1 such that the body of the user A is first showered clean (as shown in FIG. 3) and as the showering continues and the water volume has built up to a certain level, the user A again operates the said cold and hot water faucet 1 pull button 11 to alter the passageway of the three-way connector 12 and since the original water volume through the walls of the hose 1A is blocked (water is no longer supplied from the cold and hot water faucet 1) and thereby rerouted through the check valve 13 and filter 14 section in continuity with the hose 1A, the user A at this time operates the remote control unit 24 to select the desired water output mode keys 241, the signals received by the microcontroller board 23 in the controller 2 then controlling the output of water (as shown in FIG. 4) by the pressurizing motor 21 according to the remote control unit 24 keys 241 that were pressed such that the water column constituted of combined unequal weak and strong streams impact the body of the user A with the physical effect at the point of impact on the body similar to that of a massage, and comparable to a water massage in a hydrotherapy session to effectively revitalize cells, eliminate fatigue, promote metabolism, and enable physical relaxation; this approach does not require a large cost expenditure and, furthermore, is capable of solving the prior art problems faced and achieving the same effectiveness at home.

Figure 8:
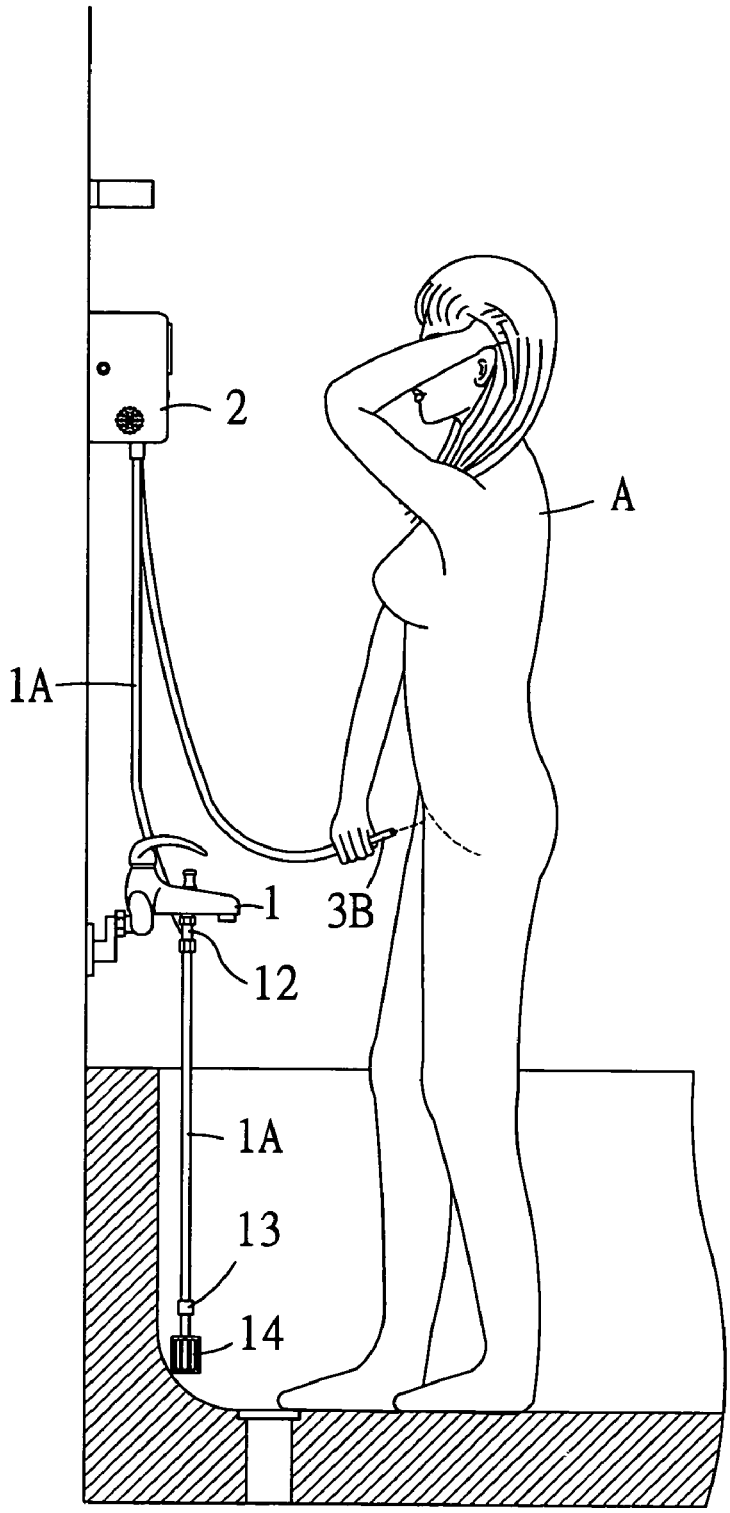
FIG. 8 is an orthographic drawing of an embodiment of the invention herein (7).

Additionally, since the volume of water utilized is continuously recirculated, water resources are conserved. The user A can of course manually hold the shower head 3 or direct the water column to impact the body in a recumbent or other posture; at the same time, a flared annular hood 32 (as shown in FIG. 5-A and FIG. 5-B) or a tubular annular hood 33 (as shown in FIGS. 6-A and 6-B) can be fitted onto the said shower head 3, enabling the force of the outputted water to massage specific areas such as the chest (as shown in FIG. 5-C), the arms, the waist, the back (as shown in FIG. 6-C), and the abdomen, etc.; and when the shower head 3 is replaced by the multi-stream nozzle 3A or the single-stream nozzle 3B, the force of the outputted water can also be utilized to massage specific areas such as the chest, the arms, the waist, the back, the abdomen (as shown in FIG. 7-A), and the soles of the feet (as shown in FIG. 7-B) as well as to wash the body (as shown in FIG. 8).

In summation of the foregoing section, since the invention herein has multi-functional, interchangeable utility and, therefore, meets the application requirements stipulated by Article 13 of the Patent Law, the present invention is submitted to the patent bureau for review and the granting of the commensurate patent rights.

The invention claimed is:

1. A household bathing water massage device comprised of a shower head connected below an existent cold and hot water faucet in a bathroom with a water volume controller installed in between, a three-way connector installed at the lower end of a pull button at the said cold and hot water faucet, a hose respectively connected to the said controller and a filter via a check valve and, furthermore, the said controller has an internally disposed pressurizing motor, frequency transformer, microcontroller board, and remote control unit, with the said remote control unit equipped with a plurality of push-type keys; as such, the user selects the said keys on the said remote control unit as desired to prompt the said controller, the signals of which are forwarded to the said microcontroller board such that the said frequency transformer controls the said pressurizing motor water output and governs the intensity of the water output force as well as changes in water volume duration, enabling a water column of variable force to impact the body of the user for water massage applications, revitalizing cells, eliminating fatigue, and promoting metabolism to thereby comfortably relax the body and spirit.

2. As mentioned in claim 1 of the household bathing water massage device of the invention herein, the said three-way connector as well as the said controller, the said check valve, and the said filter installed at the lower end of the said cold and hot water faucet pull button is placed in a bath pail or a bathtub filled with a volume of water such that the volume of water utilized is continuously recirculated by the operation of the said controller to effectively conserve water resources.

3. As mentioned in claim 1 of the household bathing water massage device of the invention herein, the said shower head consists of a water discharge rotary plate 31 having a range of large and small diameter perforations and can be fitted with various annular hoods, enabling the force of the outputted water to massage specific areas of the body.

4. As mentioned in claim 1 of the household bathing water massage device of the invention herein, the said hose connected to the said controller provides for the installation of a water discharge multi-stream nozzle.

5. As mentioned in claim 1 of the household bathing water massage device of the invention herein, the said hose connected to the said controller provides for the installation of a water discharge a single-stream nozzle.

* * * * *